US008933854B2

(12) United States Patent
Boutigny et al.

(10) Patent No.: US 8,933,854 B2
(45) Date of Patent: Jan. 13, 2015

(54) DUAL-POLARIZATION COMMUNICATION ANTENNA FOR MOBILE SATELLITE LINKS

(75) Inventors: Pierre-Henri Boutigny, Colombes (FR); Alain Le Fevre, Colombes (FR); Laurent Collin, Colombes (FR)

(73) Assignee: Thales, Nueilly sur Seine (FR)

( * ) Notice: Subject to any disclaimer, the term of this patent is extended or adjusted under 35 U.S.C. 154(b) by 417 days.

(21) Appl. No.: 13/382,142

(22) PCT Filed: Jul. 1, 2010

(86) PCT No.: PCT/EP2010/059384
§ 371 (c)(1),
(2), (4) Date: Apr. 23, 2012

(87) PCT Pub. No.: WO2011/000921
PCT Pub. Date: Jan. 6, 2011

(65) Prior Publication Data

US 2012/0200466 A1 Aug. 9, 2012

(30) Foreign Application Priority Data

Jul. 3, 2009 (FR) ..... 09 03285

(51) Int. Cl.
*H01Q 21/08* (2006.01)

(52) U.S. Cl.
USPC ..... 343/751

(58) Field of Classification Search
USPC ..... 343/751, 700 MS, 767, 853, 876, 770
See application file for complete search history.

(56) References Cited

U.S. PATENT DOCUMENTS

| | | | | |
|---|---|---|---|---|
| 5,001,492 | A * | 3/1991 | Shapiro et al. | 343/700 MS |
| 5,422,649 | A | 6/1995 | Huang | |
| 5,554,995 | A * | 9/1996 | Jun | 343/700 MS |
| 5,905,462 | A | 5/1999 | Hampel et al. | |
| 6,002,370 | A | 12/1999 | McKinnon et al. | |
| 6,067,053 | A | 5/2000 | Runyon et al. | |
| 6,208,313 | B1 * | 3/2001 | Frank et al. | 343/853 |
| 6,320,542 | B1 * | 11/2001 | Yamamoto et al. | 343/700 MS |
| 6,518,935 | B2 * | 2/2003 | Pintos et al. | 343/853 |
| 7,095,384 | B2 * | 8/2006 | Koreyasu et al. | 343/853 |
| 7,486,239 | B1 | 2/2009 | Channabasappa | |

FOREIGN PATENT DOCUMENTS

EP 1845585 A1 10/2007

OTHER PUBLICATIONS

Robert C. Hansen, "Phased Array Antennas", Wiley Series in Microwave and Optical Engineering, Jan. 1, 1998, pp. 188-199, Wiley & Sons, New York, NY, XP002180279.

* cited by examiner

*Primary Examiner* — Huedung Mancuso
(74) *Attorney, Agent, or Firm* — Baker & Hostetler LLP

(57) ABSTRACT

A dual-polarization communication antenna for satellite mobile links comprising a number of radiant elements etched on a substrate, a connector enabling the antenna elements to be connected to a power source, said antenna including one or more subantennas, each of said subantennas including: N dual-polarization antenna elements mounted in series with one another and linked together by means of a portion of a first conduction line $C_1$; K dual-polarization antenna elements linked together by means of a portion of a second conduction line $C_3$, said K antenna elements being arranged relative to one another in parallel; wherein said lines $C_1$, $C_3$ are electrically linked and linked to the connector; and the set formed by the N antenna elements is mounted in series with the set of the K antenna elements.

10 Claims, 8 Drawing Sheets

DUAL-POLARIZATION COMMUNICATION ANTENNA FOR MOBILE SATELLITE LINKS

CROSS-REFERENCE TO RELATED APPLICATIONS

This application is a National Stage of International patent application PCT/EP2010/059384, filed on Jul. 1, 2010, which claims priority to foreign French patent application No. FR 09 03285, filed on Jul. 3, 2009, the disclosures of each of which are incorporated by reference in their entireties.

FIELD OF THE DISCLOSED SUBJECT MATTER

The object of the invention relates to the antennas more particularly used in telecommunication applications with satellite mobile links.

It is notably applicable for satellite band X links. Generally, the invention relates to the applications of satellite antennas with electronic scanning for communications when moving, that is to say communications between individuals or vehicles which are moving relative to one another in time.

BACKGROUND

One of the problems in the field of satellite mobile links is how to produce compact antennas with dual polarization intended to be positioned on a mobile vehicle, and offering a high efficiency at the link level and a high gain.

In general, to have antennas of compact dimensions, "flat" forms are given preference and the antennas consist of radiant elements, better known as "patches", which are powered in order to obtain electronic scanning.

FIG. 1 represents a general architecture of an antenna consisting of a polarizer 1, a radiant panel 2 and an electronic module 3. The radiant panel comprises antenna elements that can take different forms.

FIG. 2 schematically represents a first exemplary embodiment according to the prior art, in which the radiant panel 2 comprises a number of antenna elements 4*i* and two parallel power supply distribution networks 5, 6. A first connector 7 is used to supply power to the panel with a horizontal polarization for example, via the network 5, and a second connector 8 is used for its power supply in vertical polarization mode. In this way, the antenna is supplied with power in a dual manner, horizontal polarization and vertical polarization. This network of parallel type takes the form of a binary tree of a number of lines Li of chosen impedances. Such a type of network presents the drawback of being bulky, and cannot therefore be produced on the same set of substrates as the patch-type radiant elements.

Since the concepts of horizontal polarization and vertical polarization are known to those skilled in the art, they will not be detailed in this description.

FIG. 3 represents another exemplary embodiment of an antenna according to the prior art which implements a series-type assembly, in other words one with the antenna elements all mounted in series. There is still a first connector 9 providing for the power supply for the antenna elements for a horizontal polarization, and a second connector 10 allowing for a vertical polarization of the antenna elements. The series network consists of a single set of lines of chosen impedances. The figure respectively represents a first series network 11 and a second series network 12. Such a type of network presents the advantage of having little bulk and of being able to be produced on the same set of substrates as the substrate on which the radiant elements are arranged. This antenna does, however, present the drawback of being of low bandwidth when the network is of large size. Also, the impedances of the lines lead to geometries that are often unfeasible.

SUMMARY

The object of the invention relates to a dual-polarization communication antenna for satellite mobile links comprising a number of radiant elements etched on a substrate, at least one connector C enabling the antenna elements to be connected to a power source, said antenna comprising one or more subantennas, each of said subantennas comprising at least:

- a first set $A_1$ of N dual-polarization antenna elements arranged in series with one another and linked together by means of a portion of a first conduction line $C_1$, said conduction line being divided into two at a junction point $J_1$ situated between the part of the circuit where the K elements are mounted in series and the part of the antenna where the N elements are mounted in series with one another,
- a second set $A_2$ of K dual-polarization antenna elements linked together by means of a portion of a second conduction line $C_3$, said K antenna elements being arranged relative to one another in series,
- the set $A_1$ formed by the N elements arranged in series is mounted in parallel relative to the set $A_2$ of said K antenna elements,
- said lines $C_1$, $C_3$ being electrically linked and linked to the connector C via a line $C_2$, then a line $C_4$,
- said line $C_4$ links the lines $C_2$ of the two subantennas (left and right) to the connector C,
- from the connector C to the junction point J, said lines $C_2$ and $C_4$ a given impedance value and the junction points $J_1$ and $J_2$ use impedance transformers to divide the signal into two parts,
- said conduction line $C_2$ provides the electrical link between the first set of N antenna elements and the second set of K antenna elements, and in that:

the impedance Zp of an antenna element (4*i*) by using the following relationships $$\text{Relationship No. 1: } X^2(j) = \frac{P(1)}{P(j)\Gamma^2(j)} X^2(1)$$

$$\text{Relationship No. 2: } A(j-1) = \frac{A(j)}{K^2(j)} + \frac{Zp}{X^2(j)},\ A(N+1) = 0$$

$$\text{Relationship No. 3: } Zc = K(j)Za$$

$$\text{Relationship No. 4: } Zb = A(j)Za^2$$

in which

A(j) corresponds to the admittance of the impedance transformer, followed by an impedance line Za(j), line λ/4, followed by an impedance line Zb(j): line λ/2, followed by an impedance line Zc(j): line λ/4 and ends with an admittance $$\frac{A(j)}{K^2(j)}$$

λ corresponds to the wavelength of use of the antenna.

The antenna consists, for example, considering the different layers that make up said antenna, starting from the bottom, of a first substrate comprising an etched distribution network and which is used to power all the radiant elements, a ground plane including an orifice which passes through the first substrate, the ground plane, a second substrate deposited on the ground plane and on which is etched the bottom part of the radiant elements which consist of two superposed patches, said etchings on the substrates are electrically linked by using a connection via and a conductive line, a thickness is arranged between the second substrate and a third substrate comprising an etching forming the top part of the radiant elements.

Two radiant elements can be linked by an impedance transformer cell CLj consisting of a set of three tracks etched on said substrate, a function K(j) representing the impedance transformation ratio of a cell j, said cell j being charged with an admittance Y, the output has an admittance $Y/K^2(j)$.

The impedance transformer is produced, for example, by means of three lines defining an admittance A(j) followed by an impedance line Za(j), line λ/4, followed by an impedance line Zb(j): line λ/2, followed by an impedance line Zc(j): line λ/4 and ends with an admittance $$\frac{A(j)}{K^2(j)}$$

with the following relationships:

$$Zc=K(j)Za \qquad \text{Relationship No. 3}$$

$$Zb=A(j)Za^2 \qquad \text{Relationship No. 4}$$

in which K(j) is a free function.

The antenna comprises, for example, a beam misalignment device comprising at least two diodes spaced apart by a quarter wave which are linked on the one hand to the ground M via an induction coil L, and also to a conduction line etched on the substrate at the same level as the conduction lines $C_1$, $C_2$, $C_3$ for electrically linking the different antenna elements, the line receives as input a voltage command at the input and the output is phase-shifted by a determined value by a capacitive element or stub whose function is notably to tune the duly-formed circuit to the working frequency of the antenna is linked to the anode of a diode.

The diodes are, for example, PIN-type diodes.

Said stub can be adapted to obtain a phase-shift value of the order of 30°.

The invention also relates to a method for defining a dual-polarization communication antenna for satellite mobile links comprising a number of radiant elements etched on a substrate, a connector C enabling the antenna elements to be connected to a power source, said antenna comprising one or more subantennas, characterized in that it comprises at least the following steps:

1) determining a power weighting law R(n) based on the desired pattern of the antenna or on the operation of the antenna,
2) determining the impedance Zp of an antenna element by using the following relationships $$\text{Relationship No. 1: } X^2(j) = \frac{P(1)}{P(j)\Gamma^2(j)} X^2(1)$$

$$\text{Relationship No. 2: } A(j-1) = \frac{A(j)}{K^2(j)} + \frac{Zp}{X^2(j)},\ A(N+1) = 0$$

-continued $$\text{Relationship No. 3: } Zc = K(j)Za$$

$$\text{Relationship No. 4: } Zb = A(j)Za^2$$

in which A(j) corresponds to the admittance of the impedance transformer, followed by an impedance line Za(j), line λ/4, followed by an impedance line Zb(j): line λ/2, followed by an impedance line Zc(j): line λ/4 and ends with an admittance $$\frac{A(j)}{K^2(j)}$$

λ corresponds to the wavelength of use of the antenna.

The method for determining the impedance value is, for example, the gradient method.

One of the technical problems solved by the antenna structure according to the invention is how to obtain an antenna compactness within a distance of λ/2 which corresponds to the pitch of the electronic scanning network and in which a radiant element and two distributors corresponding to the polarizations to be processed must be inserted.

BRIEF DESCRIPTION OF THE DRAWINGS

Other features and advantages of the device according to the invention will become more apparent from reading the following description of an exemplary embodiment given as a nonlimiting illustration with appended figures which represent.

DETAILED DESCRIPTION

In order to give a better understanding of the antenna structure according to the invention, the following description given as a nonlimiting illustration relates to a dual-polarization (horizontal polarization and vertical polarization) communication antenna for satellite mobile links.

Figure 1:
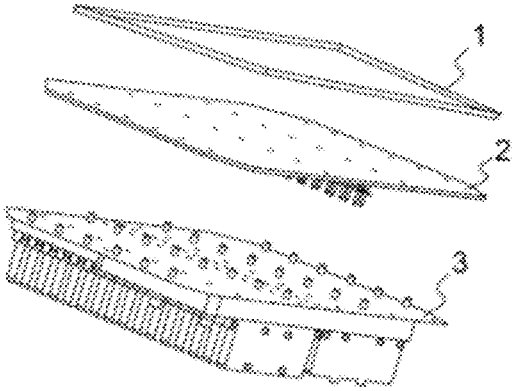
FIG. 1, an exploded view of an antenna comprising radiant patch elements.
Figure 2:
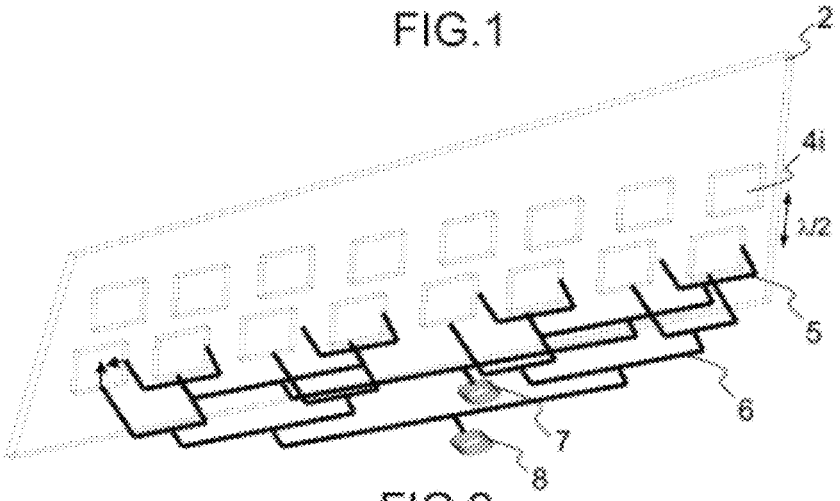
FIG. 2, a first exemplary dual-polarization antenna according to the prior art with a parallel power supply network, FIG. 3, a second exemplary antenna according to the prior art with a series power supply network, FIG. 4A, a cross-sectional view of the antenna and FIG. 4B, a view of the antenna, of the substrates, FIG. 4C an electrical block diagram of the antenna of FIG. 4B, and FIG. 4D a representation of the arrangement of the lines and of the junctions, FIG. 5, an electrical representation of an antenna element and of the cell separating two antenna elements, FIG. 6, a representation of the network in admittance mode, FIG. 7, a representation of the grouping of the admittances on the input of the network, FIG. 8, a representation of the relationship between the admittance and the impedance, FIG. 9, a representation of the implementation of the impedance transformer, FIG. 10, a detailed diagram of the conduction line portions with the patch antenna elements for the part mounted in series, FIG. 11, a representation of a device allowing for the orientation of the antenna beam according to the prior art, FIG. 12, an exemplary antenna beam orientation device according to the invention, FIG. 13, a representation of diodes connected to the conduction line for orienting the antenna beam, FIGS. 14A and 14B, the representation of a device for phase-shifting the beams from the two half-antennas represented in FIG. 4B, and FIG. 15A, a representation of the printed circuit comprising two half-antennas and a device for orienting the beams and FIG. 15B, a schematic representation of the delayed physical waves.
Figure 3:
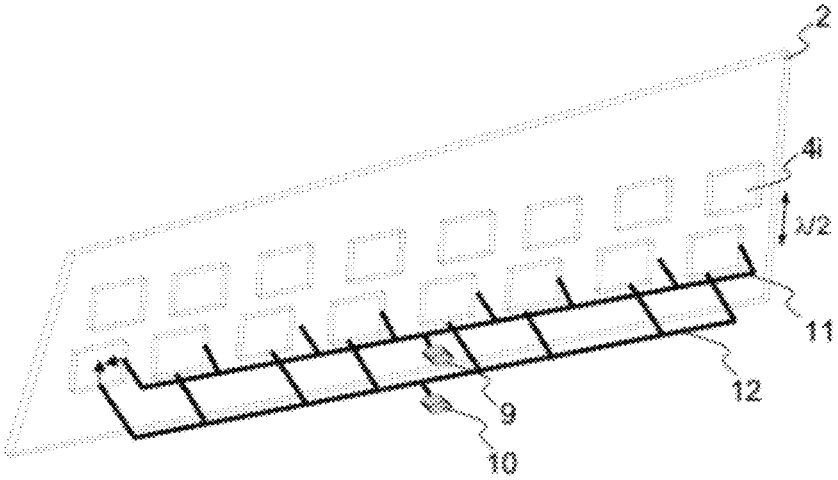

FIG. 1, as has already been mentioned, represents an antenna comprising a radiant panel 2, positioned between a polarizer 1 and an electric module 3. The pitch of the electronic scanning network corresponds to a distance of $\lambda/2$, with $\lambda$, the wavelength corresponding to the desired operating range of the antenna system.

The radiant panel 2 is used in a flat electronic scanning antenna. It is, for example, plugged into the electronic module 3 which contains the transmission and reception functions of the antenna. These functions are known to those skilled in the art and will not be detailed in this patent application. The radiant panel 2 has double linear polarization, said double polarization being converted into two circular polarizations by the polarizer 1 fixed on top of the radiant panel 2. The polarizer has a meander structure, for example. The meanders are not represented in the interests of clarity of the figure.

Figure 4A:
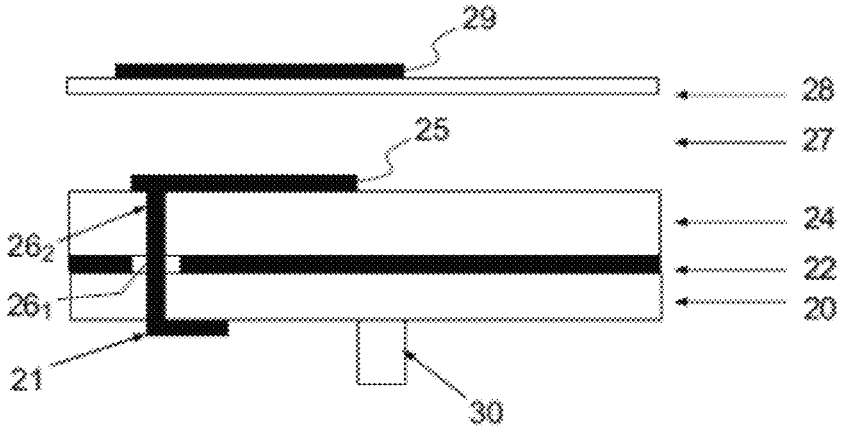

The radiant elements 4*i* are of the patch type etched on a substrate in an arrangement detailed in FIG. 4A. These radiant elements 4*i* are powered with phase and amplitude values suited to use by a circuit called distributor. The input of this distributor is equipped with a connector 30, an interface to the electronic part of the antenna, not represented in the figure.

FIG. 4A represents a cross-sectional view of an exemplary antenna according to the invention. The antenna consists, considering the different layers starting from the bottom, of a first substrate 20 comprising an etched distribution network 21 which powers all the radiant elements, a ground plane 22 including an orifice or via which passes through the first substrate 20, the ground plane 22, a second substrate 24 deposited on the ground plane 22 and on which is etched the bottom part of the radiant elements 25 which consist of two superposed patches. The etchings on the substrates are electrically linked by using a connection via $\mathbf{26}_1$ and a conductive line $\mathbf{26}_2$. A thickness of foam or air 27 is arranged between the second substrate 24 and a third substrate 28 comprising an etching 29 forming the top part of the radiant elements.

Figure 4B:
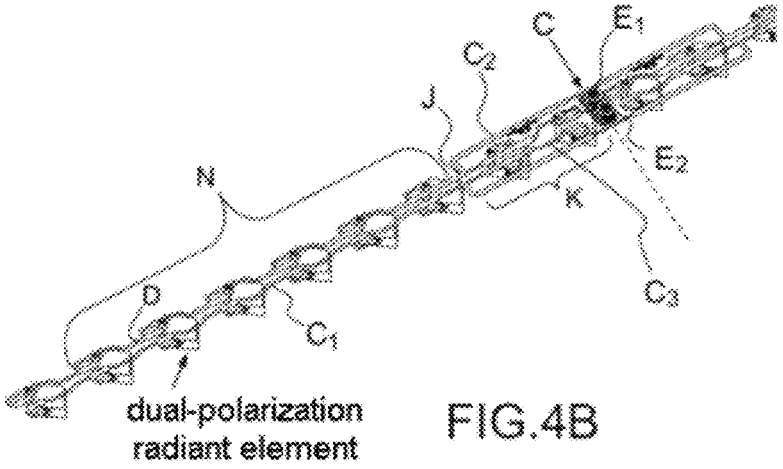

FIG. 4B schematically represents a view of the antenna according to the invention, the substrate and the ground being schematically represented as transparent, comprising N antenna elements arranged in series with one another and K antenna elements arranged in series with one another, and a connector C. The first set formed by the N elements mounted in series is mounted in parallel relative to the second set formed by the K elements mounted in series. The N antenna elements mounted in series are powered via a conduction line $C_1$ which is divided into two at a junction point J situated between the part of the circuit where the K elements are mounted in series and the part where the N elements are mounted in series with one another. The K elements are linked together by a conduction line $C_3$. The set of the N antenna elements is linked to the set of the K antenna elements by a conduction circuit $C_2$. The conduction lines and circuits meet at a junction point J. A connector C schematically represented in FIG. 4B comprises two inputs $E_1$, $E_2$ making it possible to power two half-antennas mounted as represented in the figure. On the right-hand part, only a beginning of the circuit of the antenna elements of the second half-antenna is represented. The dotted line in the diagram corresponds to the line of separation between two half-antennas.

Figure 4C:
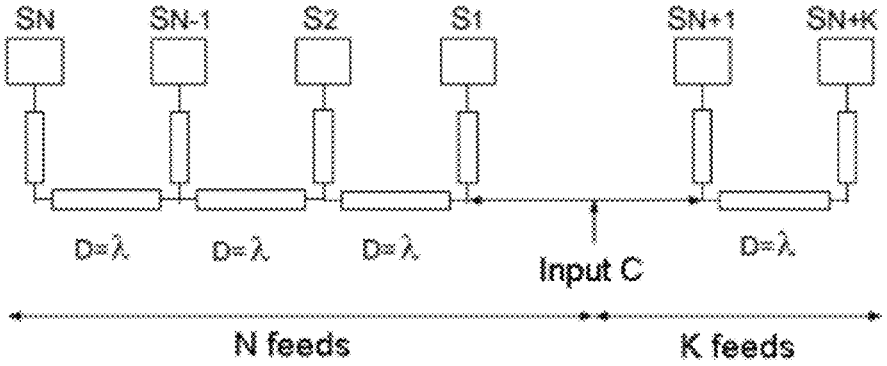

FIG. 4C is an electrical representation of the N feeds or patch antenna elements mounted in series, of the input $E_1$ corresponding to the connector C and of the K feeds mounted in series, of an antenna according to FIG. 4B. The letter D designates a cell consisting of the part of the conduction line $C_1$ arranged between two antenna elements of the series mounting (FIG. 4B). The value of D is, for example, chosen to be equal to the value of the wavelength $\lambda$ corresponding to the working or operating frequency of the antenna. The letter $E_2$ designates an input used to power the second half-antenna which is only partially represented.

Figure 4D:
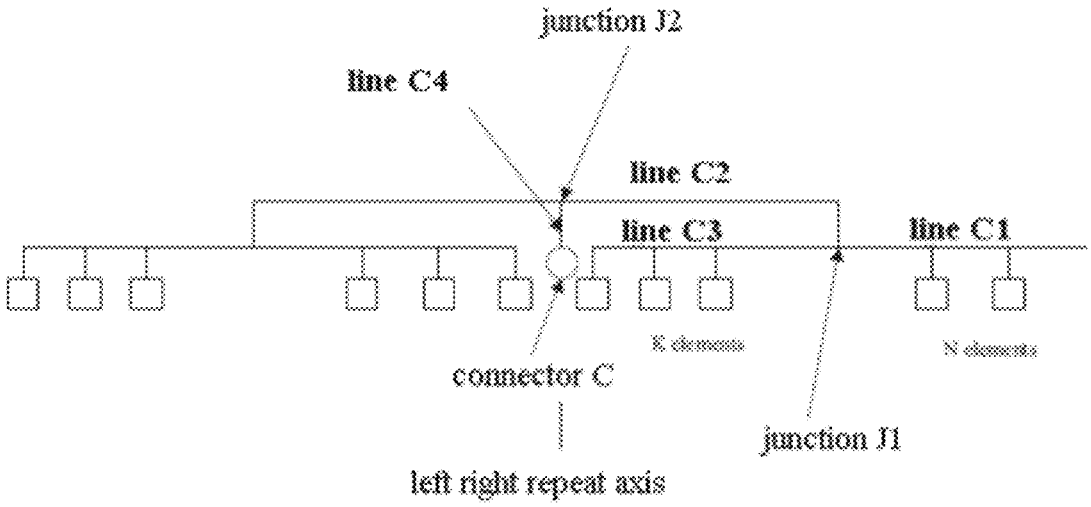

FIG. 4D schematically represents the arrangement of the different conduction lines, of the junction points relative to the N elements and to the K elements forming the antenna according to the invention.

In this figure, the connector C represents the left/right repeat axis of the elements forming the antenna.

The conduction line $C_1$ is divided into two at a first junction point J1 situated between the part of the circuit where the K elements are mounted in series and the part where the N elements are mounted in series with one another. The lines $C_1$, $C_3$ are electrically linked together and linked to the connector C via the line $C_2$ then the line $C_4$. The line $C_4$ links the lines $C_2$ of the two subantennas (left and right) to the connector C. From the connector C to the junction point J, the lines $C_2$ and $C_4$ have, for example, an impedance of 50 ohms and the junction points $J_1$ and $J_2$ use impedance transformers for the division into two parts (according to a method known from the prior art).

Figure 5:
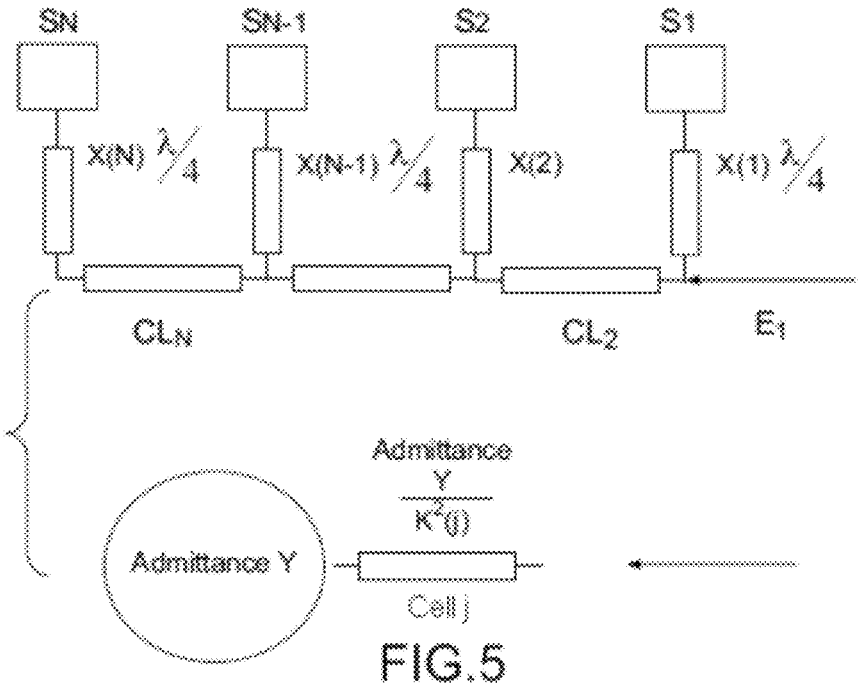

FIG. 5 represents a topology of an antenna structure according to FIGS. 4A, 4B, 4C. The electrical representation is therefore a feed 1, . . . N each corresponding to an antenna element or patch of an antenna. Each radiant element of impedance Zp is connected to the series network consisting of a line formed by the cells $CL_1 \ldots CL_N$, by a quarter-wave line of impedance X(j) in which j is the index of the feed.

The term cell designates the printed circuit etched into the substrate which is arranged between two patch elements 4*i*, 4*i*+1. Each cell (cell N . . . ) acts as an impedance transformer so that the electrical length of each cell is a wavelength, and all the radiant elements are in phase. The number of feeds is N.

The impedance transformer cell which links two radiant elements in fact consists of a set of three etched tracks as described later in FIG. 9. This arrangement makes it possible to introduce a function K(j) in which j represents the index of a cell. This function KO) represents the impedance transformation ratio of the cell j as described in FIG. 6. Thus, if the input of the cell j is loaded with an admittance Y, the output exhibits an admittance $Y/K^2(j)$. The function K(j) is free and can be optimized as will be described later in the description.

Network Parameter:

The power to be applied to each antenna element 4*i* follows a law P(n) which is the power weighting law of the antenna and which is used to obtain a radiation pattern having particular characteristics. This power law can be derived from laws known from the literature, for example: uniform weighting, Taylor's law, the cosine law.

Figure 6:
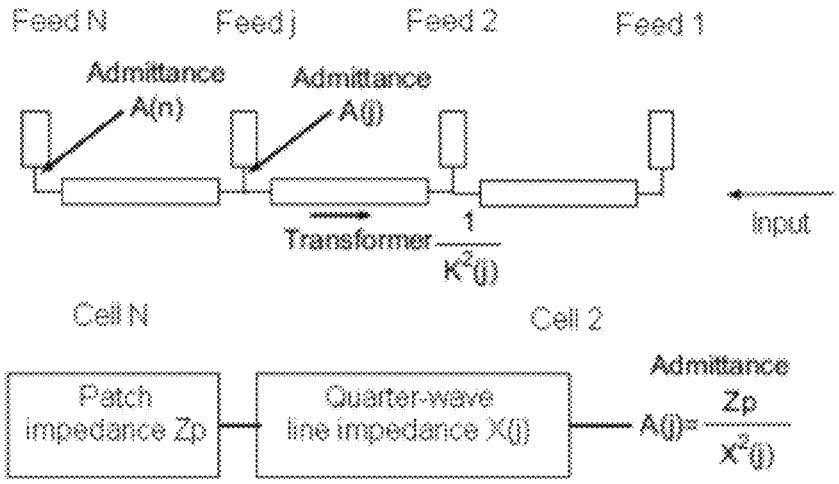

Network Relationships:

By transforming the impedances into admittances, the diagrams represented in FIG. 6 are obtained.

It is then possible to calculate the admittance Y(j) of each section of the network brought to the input plug of the network corresponding to the connector C.

There is thus obtained for the admittance A(j):

$$Y(j) = \frac{A(j)}{K^2(j)K^2(j-1)\ \ldots\ K^2(1)}$$

Figure 7:
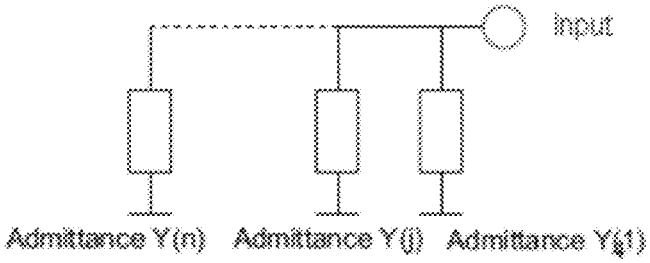

FIG. 7 schematically represents the grouping of the admittances on the input of the network corresponding, for example, to the connector C.

To simplify, the function $$\Gamma^2(j) = \prod_{m=1}^{m=j} K^2(m)$$

is introduced in which the symbol Π corresponds to the product of all the elements, m is an index which varies from 1 to j, to obtain the product of j elements.

Let the admittance Y(j) of each section of the network be $$Y(j) = \frac{A(j)}{\Gamma^2(j)},$$

which leads to $$Y(j) = \frac{Zp}{X^2(j)\Gamma^2(j)}$$

in which A(j) corresponds to the admittance of the antenna or half-antenna.

The power P(j) injected into each feed of index j is $P(j)=Y(j)*V^2$, in which V is the input voltage (voltage measured on the input connector C).

Let $$P(j) = Y(j)\frac{P(1)}{Y(1)} \text{ and } Y(j) = Y(1)\frac{P(j)}{P(1)}$$

The impedance of the quarter-wave line for the feed of index j is deduced therefrom:

$$X^2(j) = \frac{Zp}{Y(j)\Gamma^2(j)},\ X^2(j) = \frac{ZpP(1)}{Y(1)P(j)\Gamma^2(j)} \text{ with } Y(1) = \frac{Zp}{X^2(1)}$$

Each radiant element 4*i* of impedance Zp being connected to the series network by a quarter-wave line λ/4 of impedance X(j).

$$\text{Relationship No. 1: } X^2(j) = \frac{P(1)}{P(j)\Gamma^2(j)}X^2(1)$$

Figure 8:
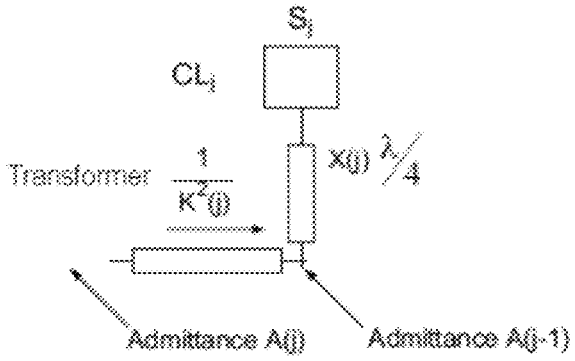

The admittance at the point A(j−1) (arrow on the right in FIG. 8) is the parallel connection of the equivalent admittance of the rest of the network A(j) (arrow on the left in FIG. 8) and of the branch including the patch.

The admittance A(j−1) is therefore the sum of two terms: $Zp/X^2$ and $A/K^2$ as given in relationship 2.

This is a recursive relationship, which will make it possible to resolve the equations by a process of approximation.

$$\text{Relationship No. 2: } A(j-1) = \frac{A(j)}{K^2(j)} + \frac{Zp}{X^2(j)}$$

A(j) being the network node admittance.

Figure 9:
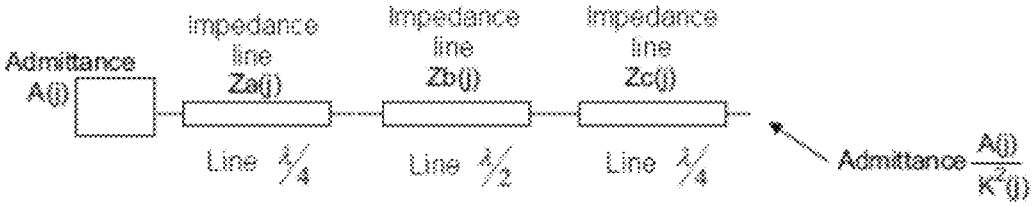
Figure 10:
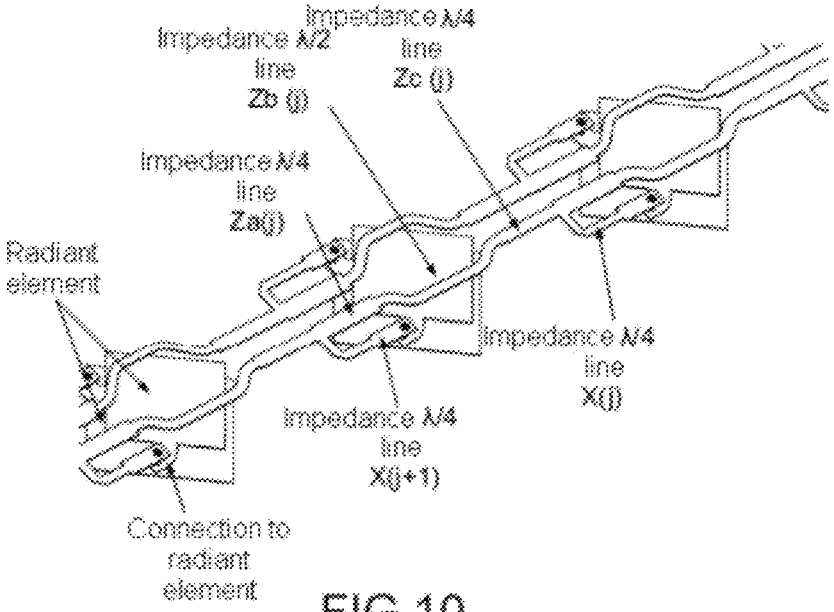

Producing the Impedance Transformer:

The impedance transformer is produced, for example, by means of three lines according to FIG. 9 schematically representing: an admittance A(j), $\mathbf{9}_1$, followed by a line $\mathbf{9}_2$ of impedance Za(j): line λ/4, followed by a line $\mathbf{9}_3$ of impedance Zb(j): line λ/2, followed by a line $\mathbf{9}_4$ of impedance Zc(j): line λ/4 and ends with an admittance $$\frac{A(j)}{K^2(j)},$$

$\mathbf{9}_5$.

Two relationships are deduced from this transformer structure:

$$Zc=K(j)Za \qquad \text{Relationship No. 3}$$

$$Zb=A(j)Za^2 \qquad \text{Relationship No. 4}$$

The values Zc and Zb corresponding to line impedance values.

Establishing these different relationships makes it possible to optimize the architecture of the network as already stated. The optimization steps implemented by the invention may be as follows:

Step 1:

Determining the power weighting law P(n) as a function of the desired pattern of the antenna or of the operation of the antenna, Step 2:

Determining the impedance Zp of an antenna element or patch,

Step 3:

Preferably using optimization software, for example in Matlab language, to determine the abovementioned impedances X Za Zb Zc from the relationships given below. The method employed may be the gradient method by using the optimization criterion formed by the sum of the squares of the 50 ohm differences (for example) of the impedance values X Za Zb Zc.

Thus, the impedance values found by the optimization method are close to 50 ohms (between 20 and 80 ohms for example) which guarantees that the geometries can be produced by etching on the printed circuit.

$$\text{Relationship No. 1: } X^2(j) = \frac{P(1)}{P(j)\Gamma^2(j)}X^2(1)$$

corresponds to the impedance value of the quarter-wave line (each radiant element of impedance Zp is connected to the series network consisting of a line formed by the cells CL1 . . . CLN, by a quarter-wave line of impedance X(j) in which j is the index of the feed).

Relationship No. 2: $A(j-1) = \frac{A(j)}{K^2(j)} + \frac{Zp}{X^2(j)}, A(N+1) = 0$ Relationship No. 3: $Zc = K(j)Za$ Relationship No. 4: $Zb = A(j)Za^2$ The description will now give an example with figures in order to better illustrate the subject of the present invention for the synthesis of a network of seven elements:

| P(1) | P(2) | P(3) | P(4) | P(5) | P(6) | P(7) |
|---|---|---|---|---|---|---|
| −0.55 dB | −1.13 dB | −1.92 dB | −2.98 dB | −4.35 dB | −6.13 dB | −8.50 dB |

−Zp = 50 ohms

The network obtained is as follows:

| X(1) | X(2) | X(3) | X(4) | X(5) | X(6) | X(7) |
|---|---|---|---|---|---|---|
| 65.3 | 67 | 65.4 | 63.8 | 58.8 | 50.8 | 56 |
| Za(1) | Za(2) | Za(3) | Za(4) | Za(5) | Za(6) | |
| 41.4 | 43 | 45 | 45.6 | 44.4 | 54 | |
| Zb(1) | Zb(2) | Zb(3) | Zb(4) | Zb(5) | Zb(6) | |
| 66 | 63.8 | 62.1 | 61.6 | 60.3 | 46.6 | |
| Zc(1) | Zc(2) | Zc(3) | Zc(4) | Zc(5) | Zc(6) | |
| 43 | 48.3 | 52.2 | 57.9 | 63.1 | 64.5 | |

The impedances obtained are close to 50 ohms.

According to one embodiment of the antenna, the antenna may also comprise an element or means for producing an antenna alignment in the direction of the chosen object, without implementing a mechanical tracking device.

The application targeted in this example is to maintain a satellite link, the antenna being installed on a mobile which may be a vehicle, a ship or an airplane. The antenna is held on the line of sight of the satellite by means of two devices:

An inertial unit and a device for measuring the residual deviation between the targeted direction and the best direction.

Figure 11:
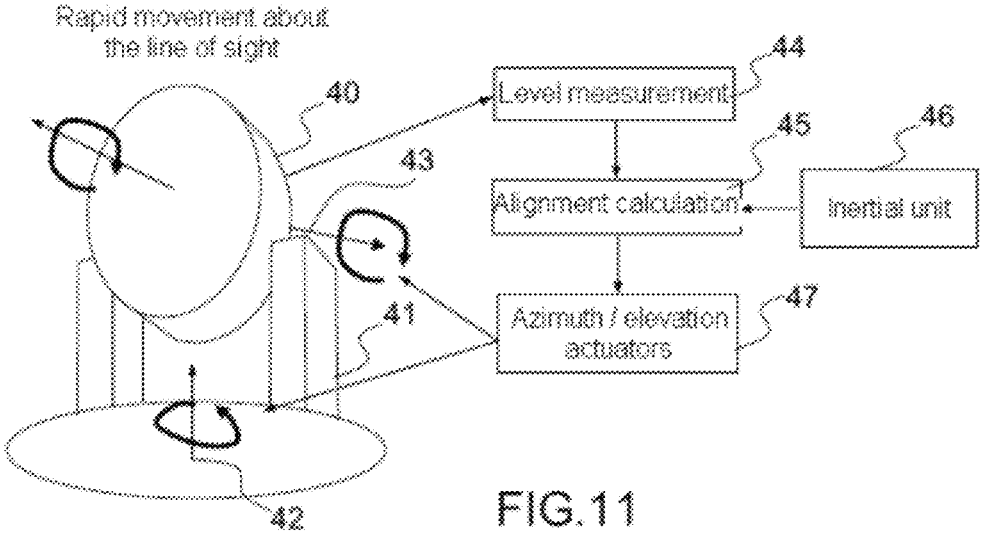

FIG. 11 represents an example of a device used in the prior art to vary the direction of alignment of the antenna. The antenna 40 is mounted on a support 41 and comprises means 42, 43 for modifying the azimuth value and the elevation value. A rapid swing movement of the antenna about the targeted direction makes it possible to indicate the direction of best reception. In the prior art, this movement is often produced by a mechanical device, motors associated with the antenna. The method consists in measuring the reception level 44 of a signal transmitted by the satellite, calculating, 45, the alignment by using information from an inertial unit 46, and, based on the calculated values, sending signals with which to actuate, rotate, 47, the antenna in azimuth and in elevation. This method is better known in the prior art by the term "conical scanning". It notably allows for a permanent reorientation of the antenna. The signal level can be determined from the measurement of the radio beacon signal. A rapid swing movement of an antenna about the directivity makes it possible to indicate the direction of best reception.

The data from the inertial unit used to calculate the alignment value are, in the example given by way of description:

the true heading (geographic North)

the true horizontal plane (plane parallel to the ground).

This is a coordinate system that is independent of the movements of the vehicle.

The idea of the present invention that will be explained in relation to FIGS. 12, 13, 14, 15A, 15B consists in varying the alignment direction without using any mechanical mechanism in normal operation of the device.

Figure 12:
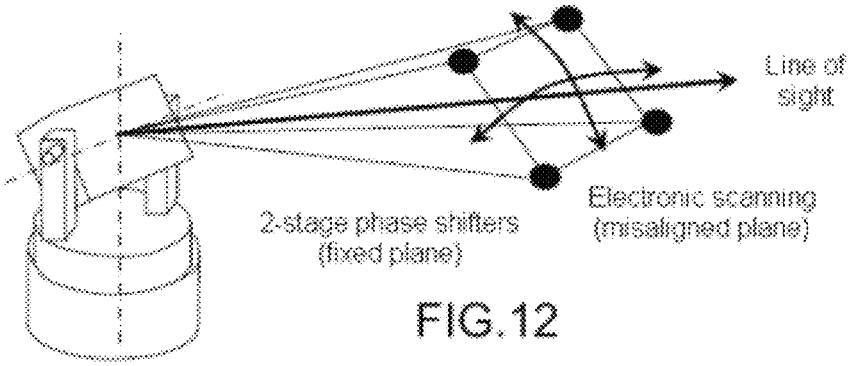

In the case of the antenna with electronic scanning in a plane, for example in elevation, the electronic scanning may misalign the beam. However, in the antenna according to the invention described previously, electronic scanning in a plane, or 1D, the beam is fixed in the other plane, for example in azimuth. To make the beam slightly mobile in this plane, two diode phase-shifters are produced on the etching of the distributor of the radiant panel. FIG. 12 schematically represents the principle of the beam movement with the proposed antenna. This figure shows the line of sight, the two-state phase-shifters and the electronic scanning. The antenna is controlled so as to be aligned regularly and successively in these four directions. On each alignment, the received signal level is measured. The signal level variation between the measurements of the four points makes it possible to estimate a direction of displacement of the antenna. The objective is to obtain an identical level over the four measurements, which corresponds to the ideal alignment.

FIGS. 13, 14, 15A and 15B detail an example of such an embodiment.

Figure 13:
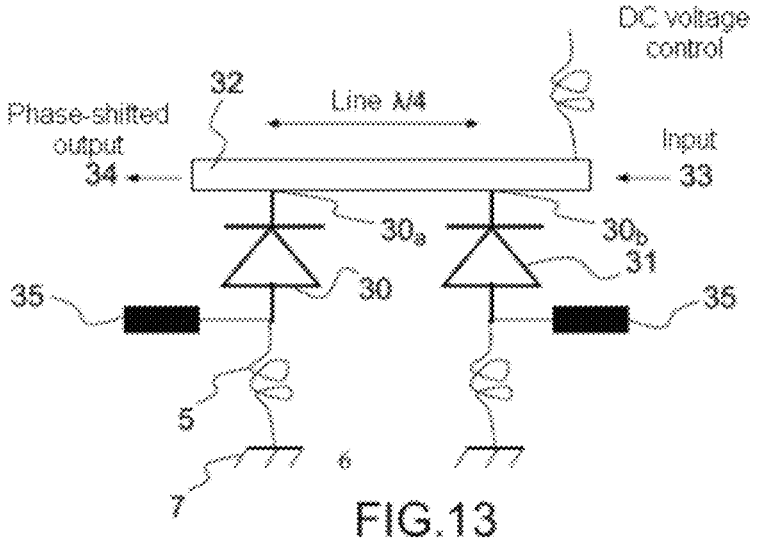

FIG. 13 represents two diodes 30, 31, for example of PIN type, spaced apart by a quarter wave which are linked on the one hand to the ground M via an induction coil L, and also to a conduction line 32 etched on the substrate at the same level as the conduction lines used to electrically link the different antenna elements. The line 32 receives as input a DC voltage command at the input 33 and the output 34 is phase-shifted by a determined value by a capacitive element 35, 36 or stub whose function is notably to tune the duly-formed circuit to the working frequency of the antenna is linked to the anode of a diode.

This stub is adjusted to obtain a phase-shift value of the order of 30°.

Figure 14A:
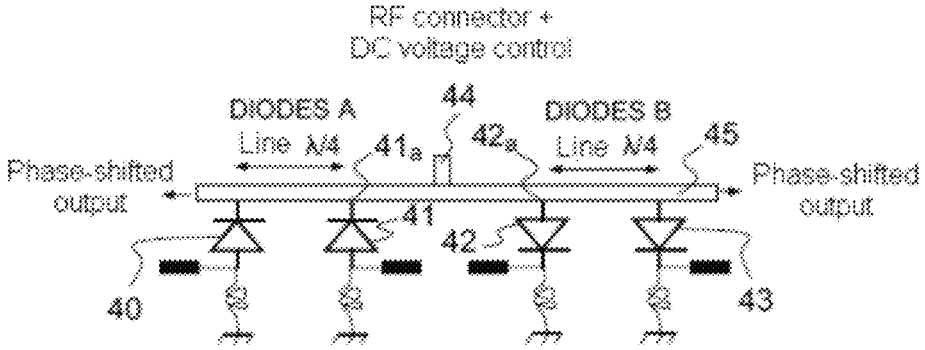

FIG. 14A represents a diagram of two diode phase-shifters produced on the etching of the substrate (FIG. 15A) with which to make the beam slightly mobile in the plane perpendicular to that of the electronic scanning. These phase-shifters allow for a slight misalignment of the beam of the antenna in the azimuth plane. The figure represents two series of two diodes 40, 41, series A; 42, 43, series B, one series being mounted head to tail relative to the other series. The input point 44 for powering the conduction line 45 and the diodes is situated, in this example, substantially mid-way between the junction points 41*a*, 42*a*, respectively corresponding to the cathode of a diode 41 of the first series and to the anode 42 of a diode of the second series. The diodes of one and the same series are mounted in the same direction.

Figure 14B:
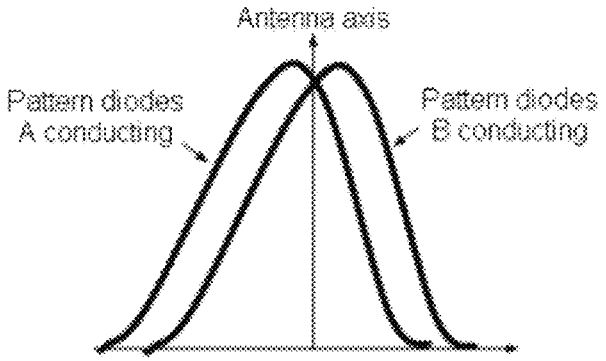

FIG. 14B represents the conduction patterns of the diodes of the series A and B of the example.

Figure 15A:
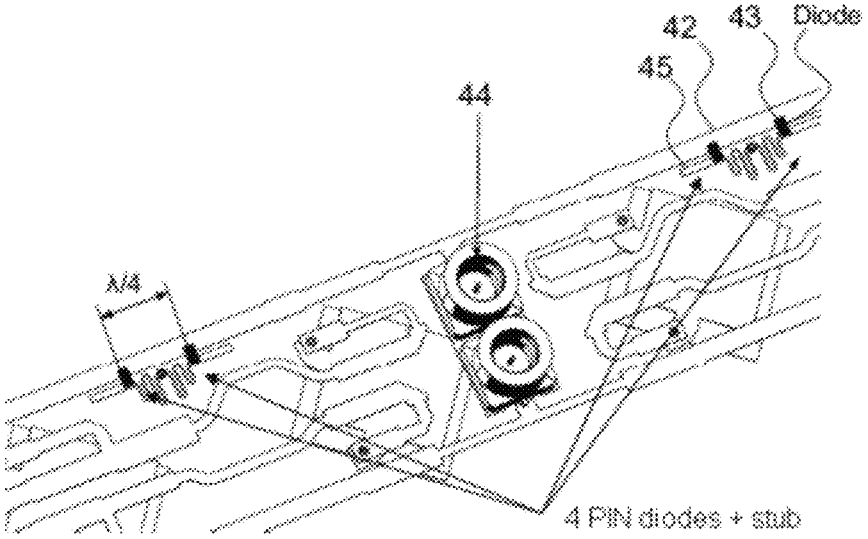
Figure 15B:
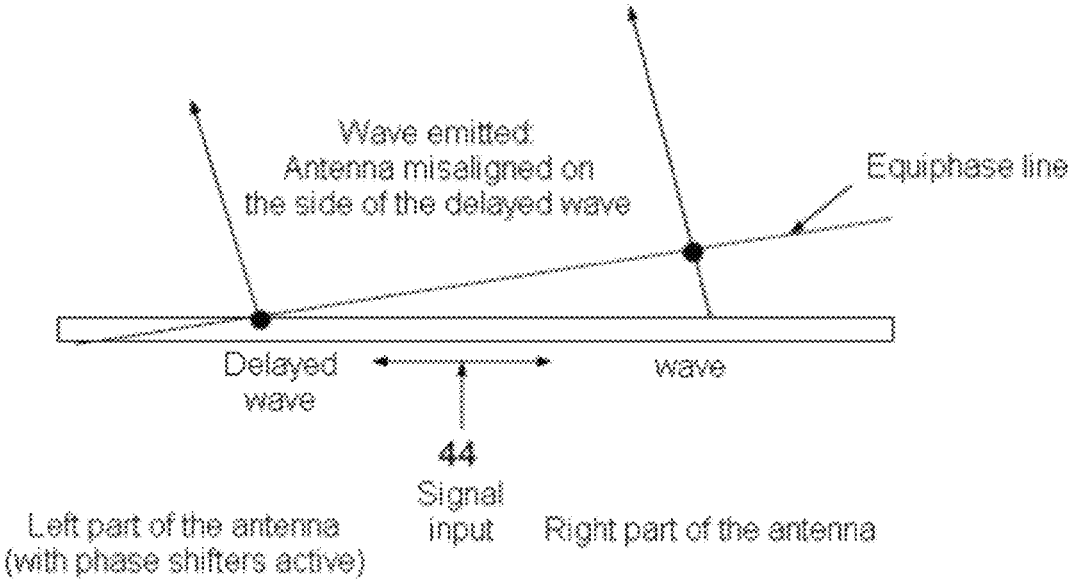

In FIG. 15A, starting from the connector 44, the wave is propagated along the line 45 and biases the diodes of each of the series. When the diodes of the series A are conducting, those of the series B are blocked. The result of this is a phase-shifting of the wave, for example by a half-wavelength (2*λ/4) of one half-antenna relative to the second half-antenna, in the case where there is a half-antenna on either side of the input connector 44. The result of this will be a misalignment of the antenna to the right or to the left. This phenomenon is represented in FIG. 15B.

The beam of the antenna misaligns on the side of the delayed wave.

The misalignment angle θ is given by:

$$\mathrm{Sin}(\theta)=(\lambda*\phi)/(2*\pi*R)$$

With λ=wavelength

ϕ=phase shift introduced by the diodes

R=size of the half-antenna.

The diode phase-shifters in this example are controlled by a DC voltage which is added to the high-frequency signal of the antenna.

The same connector can thus be used for the RF signal and the control of movement of the beam.

Advantages

The architecture of the antenna according to the invention makes it possible notably to obtain a compact antenna and the method for calculating the impedances of the series network makes it possible to obtain lines that can be produced on a printed circuit and in a given place. The architecture allows the directions of alignment in a mobile environment to be maintained.

The compactness is compatible with the production of a dual-polarization antenna in a single layer.

The invention claimed is:

1. A dual-polarization communication antenna for satellite mobile links comprising a number of radiant elements etched on a substrate, at least one connector C enabling the antenna elements to be connected to a power source, said antenna comprising one or more subantennas, each of said subantennas comprising:

a first set $A_1$ of N dual-polarization antenna elements arranged in series with one another and linked together by means of a portion of a first conduction line $C_1$, said conduction line being divided into two at a junction point $J_1$ situated between the part of the circuit where the K elements are mounted in series and the part of the antenna where the N elements are mounted in series with one another;

a second set $A_2$ of K dual-polarization antenna elements linked together by means of a portion of a second conduction line $C_3$, said K antenna elements being arranged relative to one another in series: wherein the set $A_1$ formed by the N elements arranged in series is mounted in parallel relative to the set $A_2$ of said K antenna elements;

said lines $C_1$, $C_3$ are electrically linked and linked to the connector C via a line $C_2$, then a line $C_4$;

said line $C_4$ links the lines $C_2$ of the two subantennas to the connector C;

from the connector C to the junction point J, said lines $C_2$ and $C_4$ have a given impedance value and the junction points $J_1$ and $J_2$ use impedance transformers to divide the signal into two parts;

said conduction line $C_2$ provides the electrical link between the first set of N antenna elements and the second set of K antenna elements; and the impedance Zp of an antenna element is obtained by using the following relationships $$\text{Relationship No. 1: } X^2(j)=\frac{P(1)}{P(j)\Gamma^2(j)}X^2(1)$$

$$\text{Relationship No. 2: } A(j-1)=\frac{A(j)}{K^2(j)}+\frac{Zp}{X^2(j)},$$

$$A(N+1)=0$$

$$\text{Relationship No. 3: } Zc=K(j)Za$$

$$\text{Relationship No. 4: } Zb=A(j)Za^2$$

in which

A(j) corresponds to the admittance of the impedance transformer, followed by an impedance line Za(j), line λ/4, followed by an impedance line Zb(j): line λ/2, followed by an impedance line Zc(j): line λ/4 and ends with an admittance $$\frac{A(j)}{K^2(j)}$$

λ corresponds to the wavelength of use of the antenna.

2. The antenna as claimed in claim 1, wherein it consists, considering the different layers that make up said antenna, starting from the bottom, of a first substrate comprising an etched distribution network and which is used to power all the radiant elements, a ground plane including an orifice which passes through the first substrate, the ground plane, a second substrate deposited on the ground plane and on which is etched the bottom part of the radiant elements which consist of two superposed patches, said etchings on the substrates are electrically linked by using a connection via and a conductive line, a thickness is arranged between the second substrate and a third substrate comprising an etching forming the top part of the radiant elements.

3. The antenna as claimed in claim 2, wherein two radiant elements are linked by an impedance transformer cell CLj consisting of a set of three tracks etched on said substrate, a function K(j) representing the impedance transformation ratio of a cell j, said cell j being charged with an admittance Y, the output has an admittance $Y/K^2(j)$.

4. The antenna as claimed in claim 3, wherein the impedance transformer comprises three lines defining an admittance A(j) followed by an impedance line Za(j), line λ/4, followed by an impedance line Zb(j): line λ/2, followed by an impedance line Zc(j): line λ/4 and ends with an admittance $$\frac{A(j)}{K^2(j)}$$

with the following relationships:

$$Zc=K(j)Za \qquad \text{Relationship No. 3}$$

$$Zb=A(j)Za^2 \qquad \text{Relationship No. 4}$$

in which K(j) is a free function.

5. The antenna as claimed in claim 1, further comprising a beam misalignment device comprising at least two diodes spaced apart by a quarter wave which are linked on the one hand to the ground M via an induction coil L, and also to a conduction line etched on the substrate at the same level as the conduction lines $C_1$, $C_2$, $C_3$ for electrically linking the different antenna elements, the line receives as input a voltage command at the input and the output is phase shifted by a determined value by a capacitive element or stub whose function is notably to tune the duly-formed circuit to the working frequency of the antenna is linked to the anode of a diode.

6. The antenna as claimed in claim 5, wherein the diodes are PIN-type diodes.

7. The antenna as claimed in claim 5, wherein said stub is adapted to obtain a phase-shift value of the order of 30°.

8. A method for defining a dual-polarization communication antenna for satellite mobile links comprising a number of radiant elements etched on a substrate, a connector C enabling the antenna elements to be connected to a power source, said antenna comprising one or more subantennas, the method comprising:

1) determining a power weighting law R(n) based on the desired pattern of the antenna or on the operation of the antenna,
2) determining the impedance Zp of an antenna element by using the following relationships Relationship No. 1: $X^2(j) = \frac{P(1)}{P(j)\Gamma^2(j)} X^2(1)$ -continued Relationship No. 2: $A(j-1) = \frac{A(j)}{K^2(j)} + \frac{Zp}{X^2(j)}$, $A(N+1) = 0$ Relationship No. 3: $Zc = K(j)Za$ Relationship No. 4: $Zb = A(j)Za^2$ in which A(j) corresponds to the admittance of the impedance transformer, followed by an impedance line Za(j), line λ/4, followed by an impedance line Zb(j): line λ/2, followed by an impedance line Zc(j): line λ/4 and ends with an admittance $$\frac{A(j)}{K^2(j)}$$

λ corresponds to the wavelength of use of the antenna.

9. The method as claimed in claim 8, wherein the method for determining the impedance value is the gradient method.

10. The antenna as claimed in claim 6, wherein said stub is adapted to obtain a phase-shift value of the order of 30°.

* * * * *